US009512567B2

(12) United States Patent
Cingolani et al.

(10) Patent No.: US 9,512,567 B2
(45) Date of Patent: Dec. 6, 2016

(54) PROCESS FOR PROVIDING HYDROREPELLENT PROPERTIES TO A FIBROUS MATERIAL AND THEREBY OBTAINED HYDROPHOBIC MATERIALS

(75) Inventors: Roberto Cingolani, Ceranesi (IT); Athanasia Athanasiou, Ceranesi (IT); Ilker Bayer, Genoa (IT)

(73) Assignee: Fondazione Istituto Italiano Di Tecnologia, Genoa (IT)

( * ) Notice: Subject to any disclaimer, the term of this patent is extended or adjusted under 35 U.S.C. 154(b) by 110 days.

(21) Appl. No.: 13/995,204

(22) PCT Filed: Dec. 22, 2011

(86) PCT No.: PCT/IB2011/055904

§ 371 (c)(1),
(2), (4) Date: Jun. 18, 2013

(87) PCT Pub. No.: WO2012/085879

PCT Pub. Date: Jun. 28, 2012

(65) Prior Publication Data

US 2013/0273368 A1 Oct. 17, 2013

(30) Foreign Application Priority Data

Dec. 22, 2010 (IT) ..... TO2010A1040

(51) Int. Cl.
*D21H 19/16* (2006.01)
*D06M 13/348* (2006.01)
(Continued)

(52) U.S. Cl.
CPC ..... *D21H 19/16* (2013.01); *D06M 13/348* (2013.01); *D06M 15/31* (2013.01); *D06M 23/08* (2013.01);
(Continued)

(58) Field of Classification Search
CPC ..... A61B 17/00491; A61B 17/0057; A61L 15/585; A61L 24/0015; A61L 24/06; C09D 4/00; C08L 35/04; C08F 222/32; A61K 9/16; A61K 9/0014; A61K 9/0024; A61K 9/1075; A61K 31/787; A61K 2300/00; A61K 9/0019; A61K 9/06; A61K 46/34; A61K 45/06
See application file for complete search history.

(56) References Cited

U.S. PATENT DOCUMENTS 3,017,290 A * 1/1962 Rosenthal et al. ..... 428/514
5,653,730 A * 8/1997 Hammerslag ..... 606/214
(Continued)

FOREIGN PATENT DOCUMENTS

WO 2008112652 A1 9/2008
WO 2009158046 A1 12/2009
WO 2010059833 A1 5/2010

OTHER PUBLICATIONS

Werner, et al.; Properties of Superhydrophobic Paper Treated with Rapid Expansion of Supercritical CO2 containing a Crystallizing Wax; Cellulose; (2010); 17:187-198.
(Continued)

*Primary Examiner* — Elizabeth M Cole
*Assistant Examiner* — Shawnda McKinnon
(74) *Attorney, Agent, or Firm* — Thomas|Horstemeyer, LLP

(57) ABSTRACT

Process for treating a fibrous material, to make said material hydrophobic and/or water-repellent, comprising the operation of impregnating said material with a suspension comprising nanoparticles of a hydrophobic material and a cyanoacrylate in an organic solvent and causing the crosslinking of said cyanoacrylate; the process uses an amount of cyanoacrylate and a weight ratio with the nanoparticles such as to produce complete or partial coating of the fibrous material with a matrix of crosslinked cyanoacrylate in which said nanoparticles are dispersed.

13 Claims, 7 Drawing Sheets

Figure 1A:
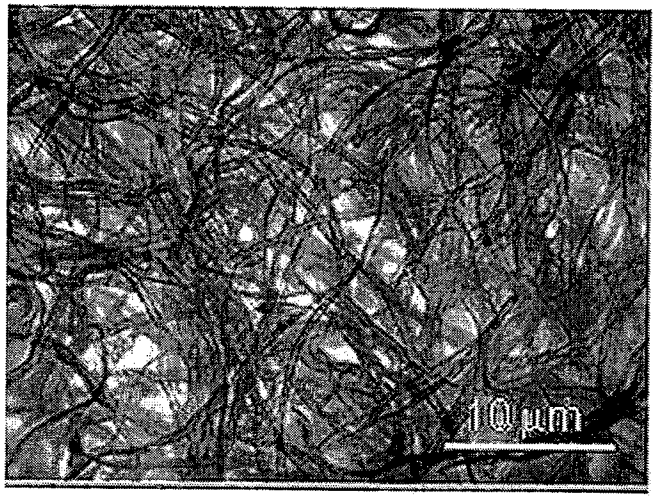

(51) Int. Cl.

| | |
|---|---|
| ***D06M 15/31*** | (2006.01) |
| ***D06M 23/08*** | (2006.01) |
| ***D21H 17/08*** | (2006.01) |
| ***D21H 21/16*** | (2006.01) |

(52) U.S. Cl.
CPC ..... *D21H 17/08* (2013.01); *D21H 21/16* (2013.01); *D06M 2200/12* (2013.01); *Y10T 428/2964* (2015.01)

(56) References Cited

U.S. PATENT DOCUMENTS

| | | | | |
|---|---|---|---|---|
| 6,183,593 | B1 * | 2/2001 | Narang et al. | 156/327 |
| 6,495,624 | B1 * | 12/2002 | Brown | 524/462 |
| 2002/0127251 | A1 * | 9/2002 | Biatry et al. | 424/401 |
| 2003/0118810 | A1 * | 6/2003 | Grantham et al. | 428/323 |
| 2005/0196431 | A1 * | 9/2005 | Narang et al. | 424/444 |
| 2006/0147829 | A1 * | 7/2006 | Huang | C09D 7/1216 430/108.6 |
| 2006/0172641 | A1 * | 8/2006 | Hennige | D06M 11/79 442/59 |
| 2006/0266258 | A1 | 11/2006 | Asakura et al. | |
| 2008/0124400 | A1 * | 5/2008 | Liggins et al. | 424/501 |
| 2008/0214075 | A1 | 9/2008 | Marte et al. | |
| 2008/0247987 | A1 * | 10/2008 | Liggins et al. | 424/78.17 |
| 2010/0233146 | A1 * | 9/2010 | McDaniel | 424/94.2 |

OTHER PUBLICATIONS

Bongiovanni, et al.; UV Light-Induced Grafting of Fluorinated Monomer onto Cellulose Sheets; Cellulose; Received: Mar. 26, 2010; Accepted Sep. 1, 2010; Springer Science+Business Media B.V. 2010.

The International Search Report and Written Opinion dated May 2, 2012.

* cited by examiner

PROCESS FOR PROVIDING HYDROREPELLENT PROPERTIES TO A FIBROUS MATERIAL AND THEREBY OBTAINED HYDROPHOBIC MATERIALS

CROSS-REFERENCE TO RELATED APPLICATION

This application is the 35 U.S.C. §371 national stage of PCT application PCT/IB2011/055904, filed Dec. 22, 2011 which claims priority to Italian Patent Application No. TO2010A001040, dated Dec. 22, 2010, both of which are incorporated by reference in their entirety.

The present invention relates to a process for conferring properties of water resistance, hydrophobicity and water repellence on fibrous materials and then to a process for production of fibrous materials and finished articles, having the aforementioned properties together with other properties, such as in particular better fireproof properties.

Recently there has been considerable interest in processes for treatment of fibrous materials for obtaining functional, environmentally sustainable products.

In many applications, especially in packaging, materials are required that are hydrophobic and self-cleaning. The traditional techniques employed for increasing these properties, as well as flame resistance, envisage processes that are expensive in economic terms and are time-consuming, for surface modification, for example reaction of cellulose with organic components (for example maleic or succinic anhydride) and the application of surface barrier coatings, which often involve the use of inorganic substances (for example metals) and polymerization processes.

Generally, all these treatments involve the use of non-biodegradable components, for example metallic or ceramic materials, or require long manufacturing steps that are unsuitable for large-scale industrial production.

In the papermaking industry, the technique most widely used for making hydrophobic paper is the use of alkyl ketene (AKT) dimers in the paper sizing stage.

The work by Werner et al. in "Cellulose" (2010) 17:187-198 reports recent developments relating to techniques for obtaining superhydrophobic paper with the use of ketene dimers and namely the techniques of a) crystallization of particles of ketene dimers from organic solvents, b) air jet with particles of cryopowdered ketene dimers and c) spraying using the RESS (Rapid Expansion of Supercritical Solutions) technique.

GB 2 469 181 A1 describes natural cellulose fibres, made hydrophobic as a result of reaction of the cellulose of the fibres with an aliphatic or aromatic anhydride.

Biongiovanni et al. in "Cellulose" (DOI 10.1007/s 10570-010-9451-5, published online on 18 Sep. 2010) describes a process for obtaining sheets of paper made hydrophobic, oleophobic and non-stick by UV radiation-induced grafting of fluorinated acrylic monomers on cellulose substrates. The sample of paper is dipped in a solution of acetone containing fluorinated acrylic monomers and a photoinitiator. After impregnation, the paper is treated with UV radiation and the solvent is extracted in a Soxhlet extractor.

WO2007/040493 also describes a process for treatment of fibrous substrates, in particular paper, to make them hydrophobic with a composition that comprises nanofillers of silica or alumina, a photoinitiator comprising an α-hydroxyketone, at least one monofunctional acrylate monomer, a diluent for oligomers and a surfactant based on crosslinkable silicone acrylate. The composition is applied on the paper, for example by spraying or dipping of the paper, and the impregnated paper is submitted to curing by exposure to heat or to actinic radiation.

One aim of the present invention is to provide a process for treating fibrous materials that is simple and economical, and makes it possible to obtain fibrous materials that have been made water-resistant.

A particular aim of the invention is to provide a process that achieves the results described above using nanocomposites that are biodegradable and biocompatible.

Another aim of the invention is to provide a process that makes it possible for the water resistance of the material treated to be controlled easily, by regulating, according to requirements, the concentration of the nanocomposite material applied on the fibrous substrate.

Another aim of the invention is to provide a process that makes it possible to obtain, in a fibrous substrate, isolating characteristics, including in particular hydrophobic properties, flame resistance, fireproof properties, self-cleaning and water-repellent properties, as well as achieving reinforcement of mechanical properties for certain substrates, for example paper.

In view of these aims, the invention relates to a process as defined in the claims given below, the text of which is to be regarded as an integral part of the technical teaching of the present description.

The invention further relates to the fibrous material obtainable by the process according to the invention, as well as to finished articles constituted of or comprising the fibrous material treated by the process of the invention.

The process according to the invention is applicable to all fibrous and porous materials, preferably of a hydrophilic nature, whether they are natural or synthetic or mixtures of natural and synthetic fibres. In particular, the process applies to fibres of cellulose and of cellulose derivatives, for example cellulose nitrate and cellulose acetate, as well as to polyester fibres including all types of synthetic and natural polyester fibres, including fibres of polylactic acid, fibres of polyethylene terephthalate or polybutylene terephthalate, for which it is desirable to increase the characteristics of water repellence, including blends of fibres of cellulose or cellulose derivatives with polyester fibres.

There are no particular limitations as to the diameter and length of the fibres; in particular, the diameter can vary between 5 μm and 100 μm, preferably between 5 μm and about 20 μm; the length can typically be between 500 μm and 10 cm, in particular between 1000 μm and 5 cm.

The fibrous material can be in the form of roving, felts or mats of chopped fibres, nonwoven fabric, optionally needle-punched felt. The process is also applicable to finished articles, such as fabrics, nonwovens, paper, felts, filters and the like.

The process according to the invention comprises the following steps:

1. preparation of a suspension comprising hydrophobic nanofillers and at least one cyanoacrylate monomer dispersed in an organic solvent;

2. application of the suspension on the fibrous material; and 3. removal of the solvent from the fibrous material thus treated and crosslinking ("curing") of the cyanoacrylate monomer.

The term "nanoparticles" means particles generally smaller than 1 μm; preferably, particles smaller than 200 nm are used; the materials used for the nanoparticles are hydrophobic materials, preferably selected from fluorinated polymers, in particular polytetrafluoroethylene, natural and synthetic waxes, for example carnauba wax, paraffin wax, beeswax, polyethylene waxes, polypropylene waxes, Fischer-Tropsch waxes, as well as polymers and copolymers of α-olefins or of cycloolefins (including in particular COC) and heavy silicone oils, for example polymers of polydimethylsiloxane; naturally, mixtures of nanoparticles of different chemical nature can be used.

The cyanoacrylate monomer or monomers preferably comprise alkylcyanoacrylates, in which the alkyl group preferably has from 1 to 8 carbon atoms, such as in particular methyl-, ethyl-, butyl- and octylcyanoacrylate. These monomers are able to polymerize rapidly by mechanisms of nucleophilic polymerization as a result of exposure even to trace amounts of water, and more specifically as a result of exposure to hydroxyl ions which are present naturally on many surfaces as adsorbed ions. The product of polymerization maintains the characteristics of biodegradability of the monomer.

The organic solvent functions as the vehicle of the suspension and its selection is not particularly critical. It is possible to use any organic solvent that allows a stable colloidal dispersion of the hydrophobic material to be obtained. In particular, solvents are preferred that are low-boiling, non-aqueous, polar or non-polar, such as acetone, chloroform and mineral oils (Stoddard solvent). Solvents based on hydrocarbons are preferred in relation to wax-based nanoparticles.

Preferably, the concentration of the cyanoacrylate monomer (or monomers) in the suspension is between 1 and 15 wt. %, concentrations of the order of 3-8 wt. %, in particular of about 5 wt. % being especially preferred.

An advantageous characteristic of the process according to the invention is that the characteristics of hydrophobicity achieved in the treated fibrous material can be controlled by adjusting the weight ratio between cyanoacrylate monomer and nanofillers. Weight ratios between cyanoacrylate monomer and hydrophobic material between 20:1 and 1:3, preferably from 5:1 to 2:1, are generally used.

In the case when waxes are used, these can be emulsified beforehand in a separate solution and then mixed in the cyanoacrylate dispersion at the desired concentration. In this way, the wax particles become encapsulated in the cyanoacrylate polymer resulting from the in-situ crosslinking, inside the fibrous matrix. This is particularly important, as it can prevent wash-out of the nanoparticles from the fibrous material, for example as a result of exposure to higher temperatures, increasing the useful life of the final treated fibrous material. The formulation of the suspension does not require the use of surfactants or of surface capping agents; however, it is to be understood that the use of said agents falls within the scope of the process according to the invention.

The suspensions thus prepared can be applied to the fibrous material using various conventional techniques, for example by dipping, spraying, rolling, or by techniques of solution casting or spray casting.

Impregnation is followed by a step of removal of the solvent, which can be effected at room temperature by heating, generally to a temperature not above 80° C.

The crosslinking of the monomer, which begins following evaporation of the solvent, is catalysed by exposure to atmospheric humidity. Crosslinking is thus effected, preferably, at room temperature in the presence of relative humidity above 30%. The conditions of room temperature and relative humidity of about 60% prove to be ideal for crosslinking; in these conditions, the crosslinking time is generally from 6 to 8 hours. The crosslinking time can however be accelerated by heating at higher temperature, preferably between 60° C. and 85° C. Moreover, crosslinking can be accelerated by immersing the fibrous material in water.

The product resulting from the process consists of hydrophobic composite fibres comprising a core of natural or synthetic fibre, provided with a coating or a shell, total or partial, of cyanoacrylate esters, in which the nanoparticles are embedded or encapsulated in the matrix of crosslinked cyanoacrylate.

The coating material is designated hereinafter as biocomposite or nanobiocomposite and can be defined as a semi-interpenetrating system, in which the nanoparticles (especially waxes and polytetrafluoroethylene) are dispersed efficiently in a crosslinked matrix of cyanoacrylate.

A specific application of the process according to the invention relates to the impregnation of paper or of fabrics or nonwovens.

Figure 1B:
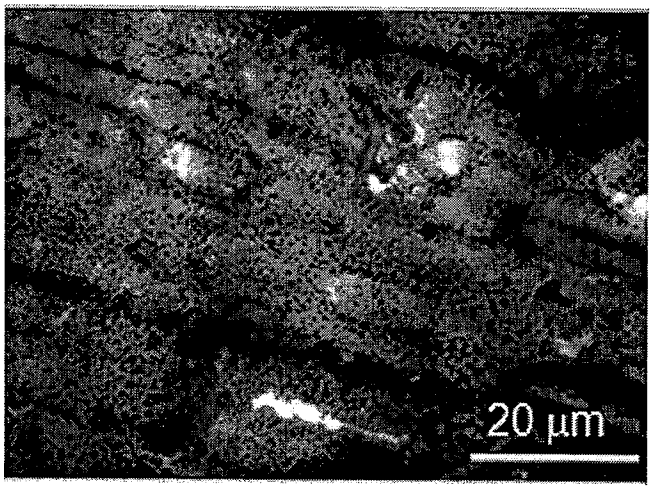
Figure 1C:
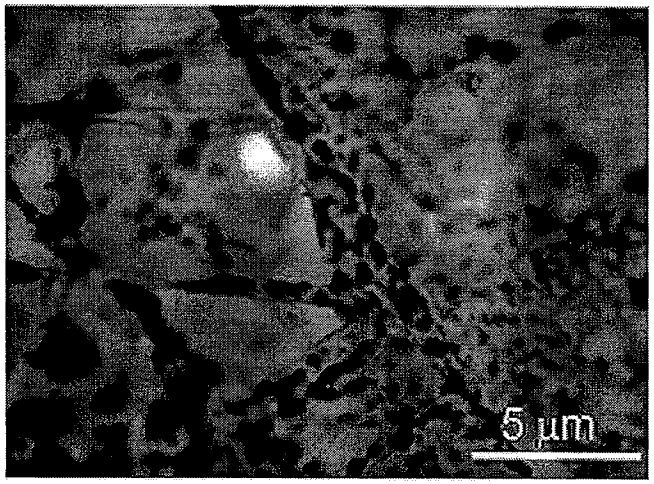
Figure 2A:
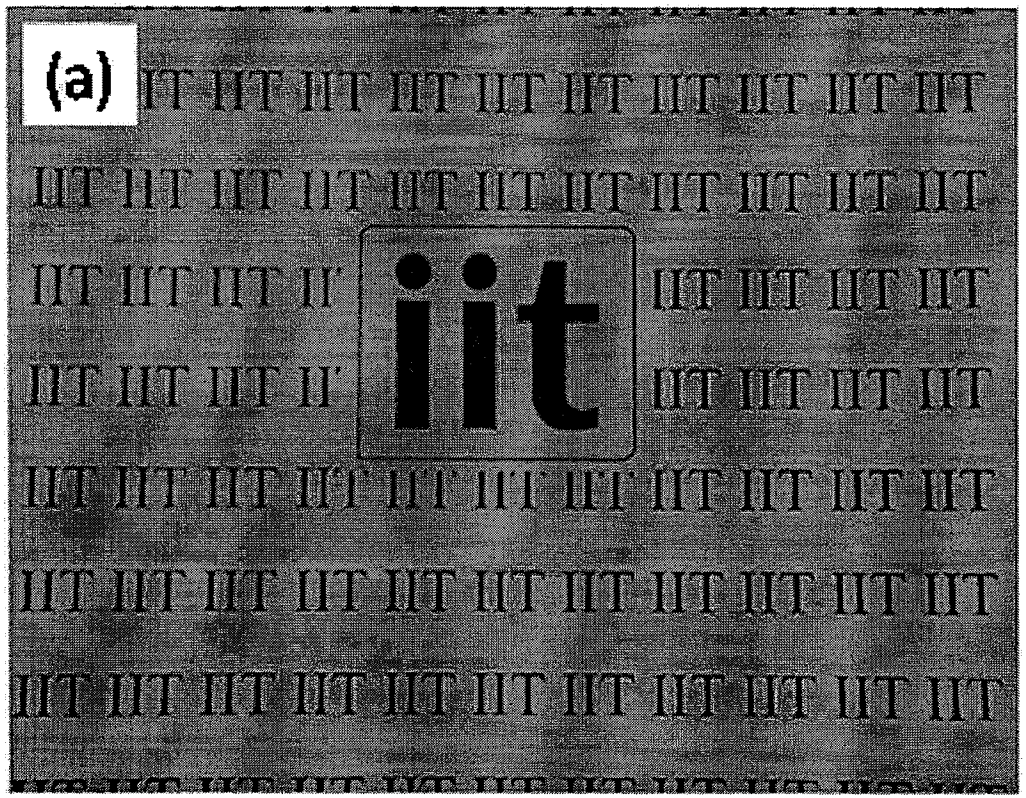
Figure 2B:
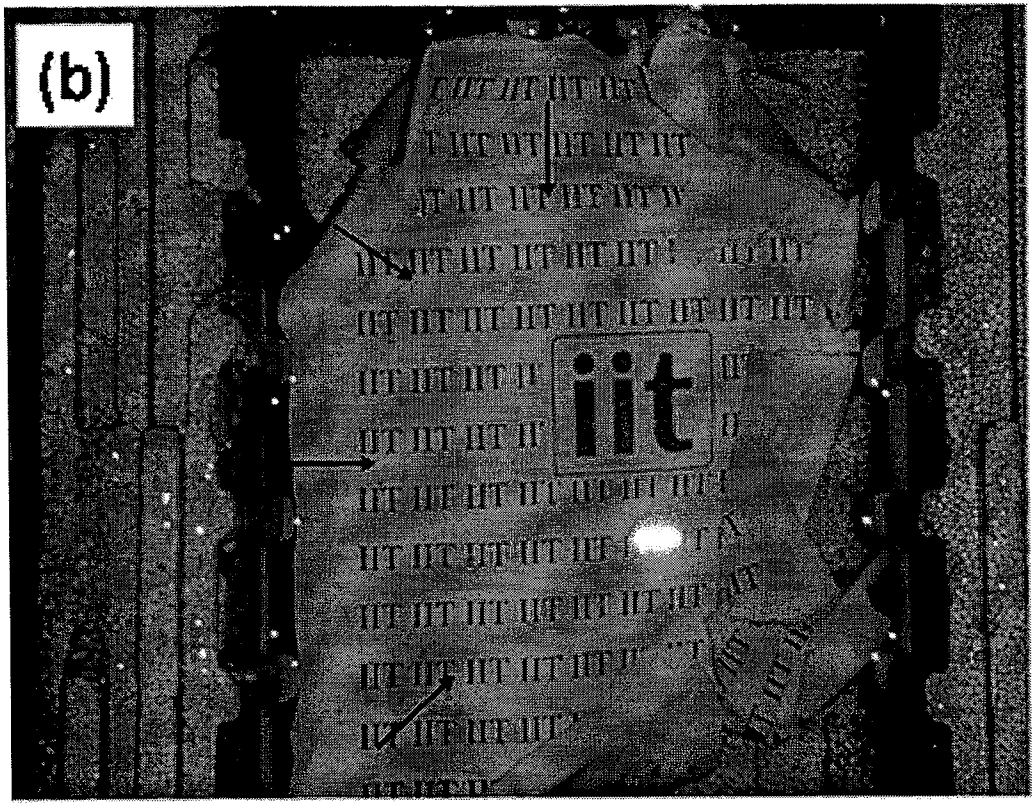
Figure 2C:
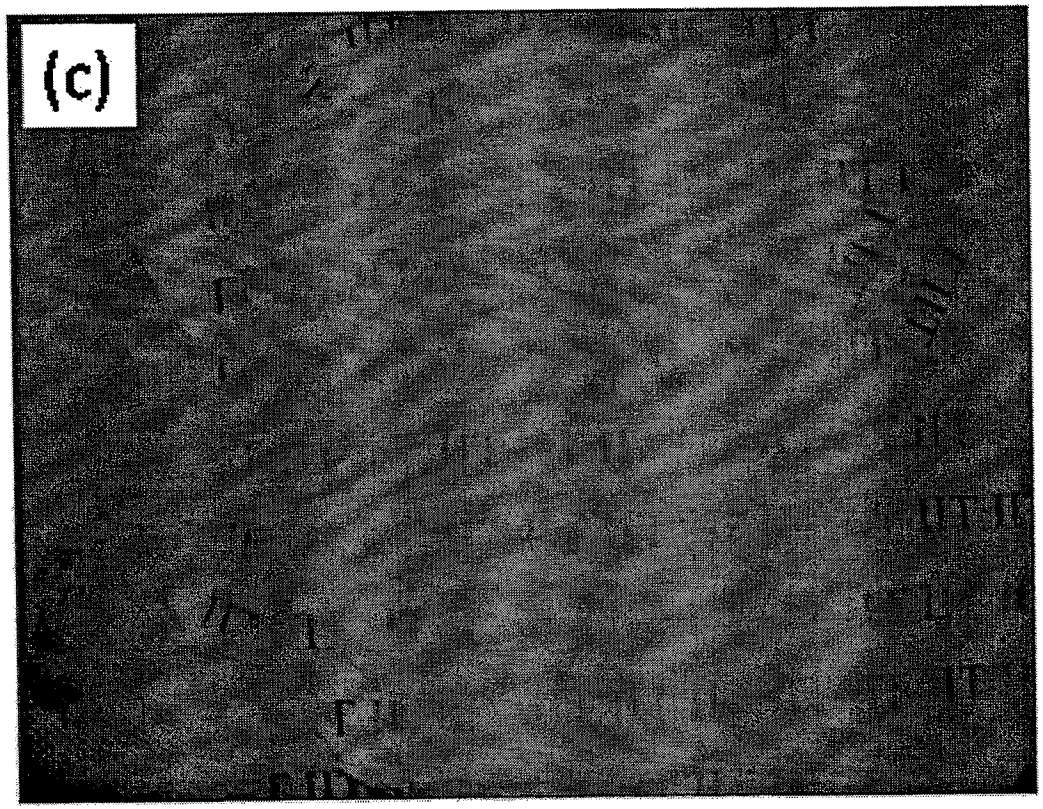
Figure 2D:
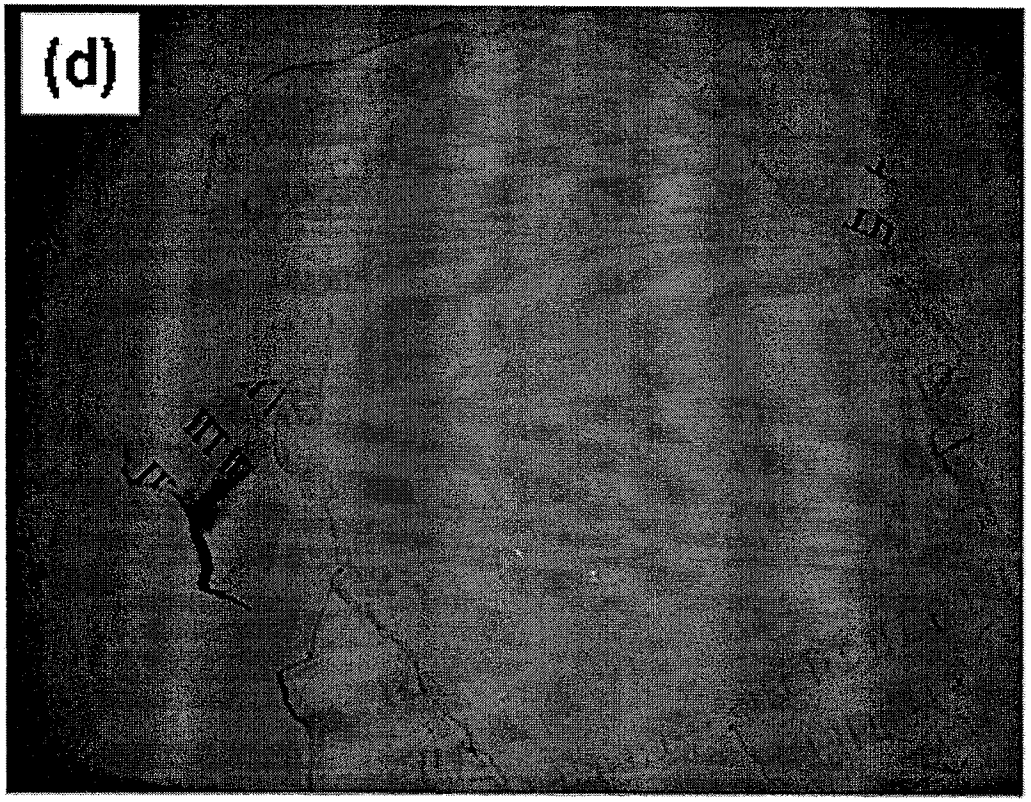

In the appended drawings:

FIG. 1*a* is a photograph obtained with an optical microscope illustrating the morphology of untreated water-absorbing fibres for paper;

FIG. 1*b* is a photograph obtained with an optical microscope of a paper impregnated with the bionanocomposite material, in which the biopolymer was crosslinked by immersion in water; the areas with dark contrast in the image illustrate the globules of cyanoacrylate polymer after rapid crosslinking in water;

FIG. 1*c* is a photograph obtained with an optical microscope, showing polytetrafluoroethylene particles of less than μm size, bound to the fibre surface by crosslinking of the biopolymer; in this case, the biopolymer was made to crosslink slowly in ambient conditions;

FIG. 2*a* is a photograph of a laser-jet-printed pattern on Xerox paper made water-repellent by impregnation with the nanobiocomposite material; the bionanocomposite material is practically invisible and does not affect the laser-jet printing process;

FIG. 2*b* is a photograph of the paper illustrated in FIG. 2*a* immersed in a water bath at room temperature; the region impregnated with the nanobiocomposite material is visible as white contrast in the centre of the region indicated with the arrows; the untreated regions of the paper start to disintegrate in water after immersion for about 5 minutes;

FIG. 2*c* is a photograph of a paper napkin placed on top of the aforementioned paper after removal from the water bath; the dry central region of the napkin corresponds to the paper impregnated with the underlying bionanocomposite material;

FIG. 2*d* is a photograph of the back of the paper, where it can be seen that the area treated is the only area that remained intact.

The following examples illustrate application of the process on paper and fabrics.

EXAMPLE 1

Preparation of Colloidal Dispersions of Cyanoacrylate Monomer/Polytetrafluoroethylene Polytetrafluoroethylene powder with particle size below 1 μm and in particular below 200 nm was used. The POLYTETRAFLUOROETHYLENE powder as received was lightly aggregated in anhydrous form. In a typical procedure, the polytetrafluoroethylene particles were dispersed in chloroform or acetone and sonicated for 30 minutes at room temperature, without adding surfactants or dispersants. After sonication, the polytetrafluoroethylene suspension was stable and no large aggregates were present in solution. The ethylcyanoacrylate monomer was added slowly, dropwise, to this solution, until the desired concentration of monomer was reached, i.e. a concentration of 5 wt. %.

The suspension was sonicated again for 30 minutes at room temperature; optionally, the final solution can be further diluted with solvents, such as acetone, chloroform and mineral oils (Stoddard solvent), depending on the application and the desired rate of evaporation. The degree of hydrophobicity of the monomer/polytetrafluoroethylene suspension depends on the monomer/polytetrafluoroethylene ratio in suspension. For the purpose of making the fibrous materials highly water-repellent, it was found that a monomer/polytetrafluoroethylene ratio equal to 2:1 was sufficient in dispersions in which the total solids content was 10 wt. %.

EXAMPLE 2

Preparation of a Colloidal Dispersion of Cyanoacrylate Monomer/Wax

Paraffin wax or commercially available Parafilms (Sigma-Aldrich) were dispersed in chloroform, toluene or Stoddard solvent. The wax or the Parafilm does not dissolve immediately in the solvents and complete dissolution was not possible even after a week. In order to disperse the wax or the Parafilm completely in the solvents, the solutions were heated at 90° C. for 15 minutes, stirring continuously after the second day of preparation. After the solutions had cooled to room temperature, the wax or the Parafilm was completely dispersed in the aforementioned solvents.

The ethylcyanoacrylate (ECA) monomer was dispersed separately in each of the aforementioned solvents. The dispersions of wax and ECA were mixed and the mixtures were sonicated for 30 minutes at room temperature. The final mixture was extremely stable and no phase separation was observed after a week of preparation of the mixed solutions. The solutions of wax and ECA could be mixed in any proportions, making it possible to control the hydrophobicity of the resultant composite. An ECA/wax weight ratio of 2:1 proved sufficient to make fabrics, particularly those based on cotton, superhydrophobic (water-repellent).

It is known that both the ECA/paraffin wax composite and crosslinked ECA are relatively brittle, compared with rubber-based resins. In order to induce greater flexibility, it is possible to use Parafilm, which is a mixture of paraffin wax and polyolefin resin, in place of paraffin wax, depending on the applications or the desired properties.

EXAMPLE 3

Manufacture of Hydrophobic Paper

Hydrophobic and water-repellent paper was obtained by impregnating Xerox photocopying paper with ECA/wax mixtures as described above. Impregnation was performed using a 5% dispersion of solids with an ECA/wax or Parafilm ratio equal to 2:1. Impregnation was performed by techniques of dip coating, solution casting or spray casting. The solvent was left to evaporate at room temperature. After evaporation of the solvent, ECA begins to crosslink in situ, encapsulating some of the wax and at the same time coating the fibres.

In ambient conditions, crosslinking of ECA took about 7 hours. At the end of the process, no change in appearance, thickness and colour of the paper could be seen. The contact angles measured on the treated region of the paper were on average 110°, indicating a good degree of hydrophobicity. The papers could be printed using laser-jet printers, without loss of print quality (see the tests in FIGS. 2*a*-2*d*).

EXAMPLE 4

Preparation of Super-Water-Repellent Paper or Fabrics

Superhydrophobic paper or superhydrophobic fabrics were obtained by spray coating a dispersion of ECA/polytetrafluoroethylene in 2:1 ratio, with a total solids concentration of 5 wt. %.

ECA/polytetrafluoroethylene dispersions were also used for spray coating papers and fabrics with a Paasche airbrush. After crosslinking in ambient conditions, the contact angles of the treated paper or of the fabrics exceeded a value of 160°. The coated surfaces were extremely stable even after two weeks of exposure at room temperature. The process was also applied on low-density filter papers, for example papers for cleaning lenses, which were made superhydrophobic.

For the purpose of further increasing the degree of water repellence, it also proved to be possible to apply the nanosuspension in several successive stages, for example by carrying out a first stage of application by impregnation of the paper by dipping in the suspension and, after complete crosslinking, carrying out a second stage of application of the nanosuspension, for example by spray casting.

The invention thus provides a simple and economical process for making commercially available fibrous materials and finished articles water-repellent, avoiding complex methods of production of water-repellent nonwoven materials or packaging materials.

In the process according to the invention, the bionanocomposite coating material is formed within the fibrous matrix, by crosslinking in situ, using atmospheric humidity as catalyst; therefore the process does not require expensive technology for thermal crosslinking or crosslinking with ultraviolet radiation.

The process can be easily transferred from the laboratory scale to the industrial scale, since the water-repellent nanocomposite material is introduced and impregnated in the fibrous matrix in liquid form.

Moreover, no pretreatment steps are required for the substrate to which the process is applied; since the process uses a low-viscosity liquid dispersion or suspension as starting material, it is possible to achieve effective coating of the surface of the fibres by simple wetting of the surfaces of the fibres with said dispersion or suspension.

Depending on the choice of hydrophobic material, the nanocomposite coating material can be completely biodegradable.

Since the nanocomposite coating can be formed by crosslinking catalysed in situ by moisture, the nanocomposites have excellent adhesion to fibrous materials, especially cellulose, polyester, cotton, but also to synthetic materials such as polyamide fibres that are exposed naturally to environmental or atmospheric moisture.

What is claimed is:

1. Process of treating a fibrous material, to make the material hydrophobic and/or water repellent, including the operation of:

impregnating said material with a suspension consisting of nanoparticles of a hydrophobic material and a cyanoacrylate in an organic solvent, wherein said cyanoacrylate is an alkylcyanoacrylate monomer or a mixture of alkylcyanoacrylate monomers in a concentration from 1% to 15% by weight, referred to the weight of the suspension, the weight ratio between cyanoacrylate monomer and hydrophobic material in said suspension being between 5:1 and 2:1;

removing said organic solvent from said impregnated material;

causing crosslinking of said cyanoacrylate, the concentration of the cyanoacrylate in said suspension and its weight ratio relative to said nanoparticles being such as to produce complete coating of the fibrous material with a matrix of crosslinked cyanoacrylate in which said nanoparticles are dispersed; and wherein the crosslinking of said cyanoacrylate is implemented by exposing the fibrous material, treated with such a suspension after the removal of the solvent, to an environment with relative humidity exceeding 30%.

2. Process according to claim 1, characterized in that said cyanoacrylate is an alkylcyanoacrylate, in which the alkyl has from 1 to 8 carbon atoms, or a mixture of said alkylcyanoacrylates.

3. Process according to claim 1, characterized in that said hydrophobic material is selected from fluorinated polymers, natural or synthetic waxes, polymers or copolymers of α-olefins or of cycloolefins and polymers of polydimethylsiloxane.

4. Process according to claim 1, characterized in that said hydrophobic material is a wax, selected from carnauba wax, paraffin wax, beeswax, polyethylene waxes, polypropylene waxes and Fischer-Tropsch waxes.

5. Process according to claim 1, characterized in that said hydrophobic material is polytetrafluoroethylene.

6. Process according to claim 1, characterized in that said fibrous material includes cellulose fibres or cellulose-derivative fibres, natural or synthetic polyester fibres and mixtures thereof.

7. Process according to claim 6, characterized in that said fibrous material includes fibres, selected from cellulose, cellulose nitrate, cellulose acetate, polylactic acid, polyethylene terephthalate, polybutylene terephthalate fibres and mixtures thereof.

8. Process according to claim 1, wherein said alkycyanoacrylate monomer or a mixture of said monomers is present in said suspension in a concentration from 3% to 8% by weight, referred to the weight of the suspension.

9. Process according to claim 1, characterized in that said organic solvent is selected from the group consisting of acetone, chloroform and mineral oils.

10. Process according to claim 1, characterized in that said suspension is applied to the fibrous material by dipping the material in said suspension, by spraying, by rolling or by techniques of solution casting or spray casting.

11. Process according to claim 1, including the operations of removing the solvent from the fibrous material treated with this suspension, by evaporation of the solvent at a temperature not exceeding 85° C.

12. Process according to claim 1, in which the crosslinking of said cyanoacrylate is implemented by exposing the fibrous material, treated with such a suspension after the removal of the solvent, to an environment with relative humidity not less than 60%, with heat treatment at a temperature not exceeding 85° C.

13. Process according to claim 1, characterized in that said hydrophobic material is polydimethylsiloxane.

* * * * *